United States Patent [19]

McSherry et al.

[11] 4,174,910

[45] Nov. 20, 1979

[54] PAPER CLIP AND BINDER DEVICE

[75] Inventors: Thomas W. McSherry, Floral Park; Nathaniel H. Garfield, Harrison, both of N.Y.

[73] Assignee: Mechanical Plastics Corp., Pleasantville, N.Y.

[21] Appl. No.: 882,052

[22] Filed: Feb. 28, 1978

[51] Int. Cl.[2] ..... B42F 13/02

[52] U.S. Cl. ..... 402/19; 402/8; 402/9; 402/21; 402/60

[58] Field of Search ..... 402/8, 9, 19, 21, 62, 402/58, 60

[56] References Cited

U.S. PATENT DOCUMENTS

| | | | |
|---|---|---|---|
| 114,504 | 5/1871 | Young | 402/19 X |
| 283,653 | 8/1883 | Paxson | 402/62 X |
| 754,791 | 3/1904 | Mentzer | 402/21 |
| 1,305,589 | 6/1919 | Deason | 402/62 X |
| 2,253,464 | 8/1941 | Spector | 402/19 X |
| 2,317,345 | 4/1943 | Peters | 402/9 |
| 3,516,755 | 6/1970 | Smith | 402/9 |

FOREIGN PATENT DOCUMENTS

| | | | |
|---|---|---|---|
| 408859 | 1/1925 | Fed. Rep. of Germany | 402/8 |
| 2649723 | 9/1977 | Fed. Rep. of Germany | 402/19 |
| 394334 | 6/1933 | United Kingdom | 402/9 |
| 565863 | 12/1944 | United Kingdom | 402/8 |

*Primary Examiner*—Robert L. Spicer, Jr.
*Attorney, Agent, or Firm*—Pennie & Edmonds

[57] ABSTRACT

An improved sheet binding device for fastening together a plurality of sheets having pre-punched, spaced-apart openings, comprises an elongated backing member extending between such spaced-apart openings; and, attached to the backing member at spaced-apart positions corresponding to the spacing between such openings, a plurality of fastening elements, each comprising a connecting portion for insertion into such openings, and at the end of said connecting portion remote from said backing member, locking means movable between (1) a collapsed position in which the fastening element is insertable into such opening, and (2) an expanded position in which the locking means is effective to preclude removal of such sheets from said fastening element. This structure can be integrally molded from plastic material. In a preferred embodiment, the structure is substantially self-locking. Single-hole embodiments suitable as replacements for conventional brass head fasteners are also disclosed.

17 Claims, 14 Drawing Figures

PAPER CLIP AND BINDER DEVICE

BACKGROUND OF THE INVENTION

1. Field of the Invention

This invention relates to an improved paper clip and binder, and, in particular, to a self-locking clip or binder which can preferably be integrally molded of plastic material.

2. History of the Art

One of the most popular paper binding devices in current use is the two-part metal binder. In substance, this binder comprises an elongated metal backing portion, a pair of elongated metal insert tabs disposed at opposite ends, and an elongated, grooved metal front portion having tab-receiving apertures at opposite ends and a pair of slidable locking members. In operation, the backing member is placed under a pile of papers to be secured and the metal tabs are inserted through pre-punched spaced-apart holes in the paper. The tabs are then secured to the locking portion by inserting them through the receiving apertures. The tabs are then bent down into the groove, and the locking members are slid over their respective ends. In some fasteners of this type, the backing member is also provided with pointed, bendable teeth for securement to a cover.

The difficulties associated with the use of these binders are manifold. To be used and re-used, two separate parts must be assembled and disassembled. Re-use is limited because the metal insert tabs tend to take on permanent deformations after successive bendings. In addition, in use the separate front portions are frequently removed and lost or misplaced. All of the metal components are thin and have relatively sharp edges which can cut the paper being bound, underlying files, and the fingers of users. Moreover, the sliding locking members do not provide reliable locking and are as likely to slide off the insertion tabs as they are to stay there.

In addition, the manufacture of these fasteners is inherently inefficient as compared to integral molding. Four separate parts must be stamped out of sheet metal, the back, the front, and two slide strips, and the slide strips must be assembled onto the front member.

SUMMARY OF THE INVENTION

In accordance with the invention, an improved sheet binding device for fastening together a plurality of sheets having pre-punched, spaced-apart openings, comprises an elongated backing member extending between such spaced-apart openings; and, attached to the backing member at spaced-apart positions corresponding to the spacing between such openings, a plurality of fastening elements, each comprising a connecting portion for insertion into such openings, and at the end of said connecting portion remote from said backing member, locking means movable between (1) a collapsed position in which the fastening element is insertable into such opening, and (2) an expanded position in which the locking means is effective to preclude removal of such sheets from said fastening element. This structure can be integrally molded from plastic material. In a preferred embodiment, the structure is substantially self-locking. Single-hole embodiments suitable as replacements for conventional brass head fasteners are also disclosed.

BRIEF DESCRIPTION OF THE DRAWINGS

The nature, advantages and various additional features of the invention will appear more fully upon consideration of the illustrative embodiments now to be described in detail in connection with the accompanying drawings.

In the drawings.

For convenience of reference, similar structural elements are given the same reference numeral throughout the drawing.

DETAILED DESCRIPTION OF THE DRAWINGS

Figure 1A:
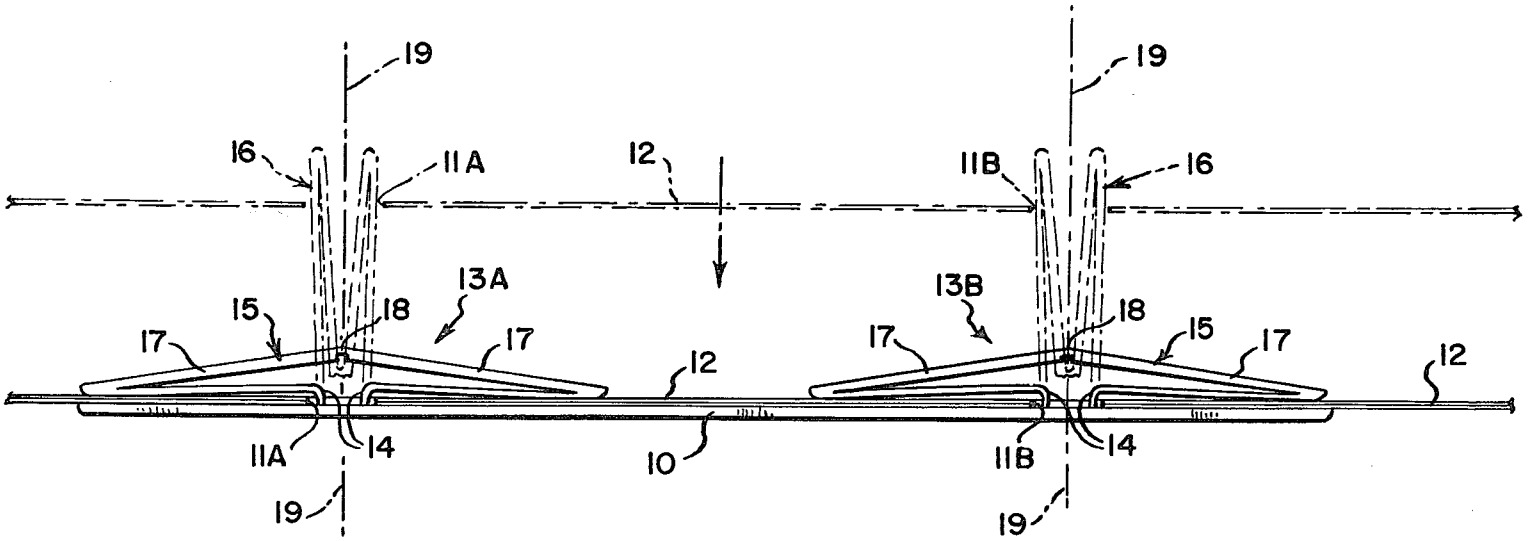
FIGS. 1A and 1B are side and top views, respectively, of a first embodiment of a sheet binding device in accordance with the invention.
Figure 1B:
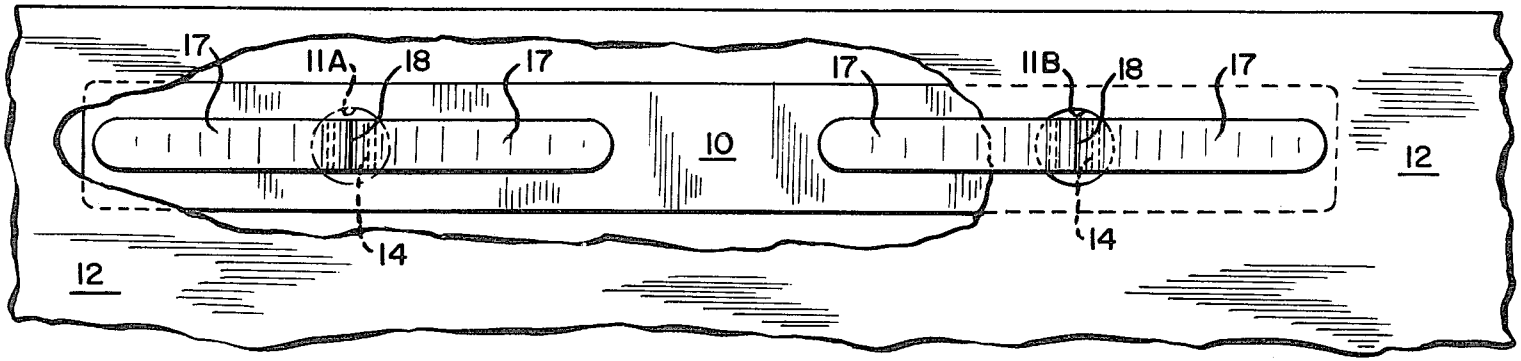

Referring to the drawings, FIGS. 1A and 1B are side and top views respectively of a sheet binding device in accordance with the invention comprising a backing member 10, which can be an elongated plastic strap, extending between the pre-punched, spaced-apart openings 11A and 11B of a plurality of aligned paper sheets 12; and, attached to the backing member at spaced-apart positions corresponding to the spacing between openings 11A and 11B, a pair of fastening elements 13A and 13B. Each fastening element comprises a connecting portion, here a pair of pillar-like members 14, connecting the backing member to a locking means 15 which is movable between a collapsed position 16, in which the fastening element is insertable into the pre-punched openings, and an expanded over-center locking position in which the locking means is effective to preclude removal of the sheets from the fastening element.

In a preferred arrangement, each locking means comprises a pair of substantially rigid arms 17 connected to pillar-like members 14 and connected to each other on a longitudinal axis of the fastener by a relatively thin integral strap 18 so as to be removable towards and away from each other in a plane including the longitudinal axis 19.

Preferably backing member 10 extends beyond each fastener and the arms of each fastener are so shaped or curved that in their locking position, they resiliently bias the paper into contact with the extended backing member. Such resilient contact substantially reduces stresses on the paper surrounding the prepunched apertures and greatly reduces the frequency of torn-out holes commonly observed in conjunction with the use of conventional fasteners.

These fasteners can conveniently be fabricated as integrally molded structures of resilient plastic, such as polypropylene. They can be made by molding them with the fasteners in the open position in a multi-cavity mold using conventional injection molding techniques.

Figure 2A:
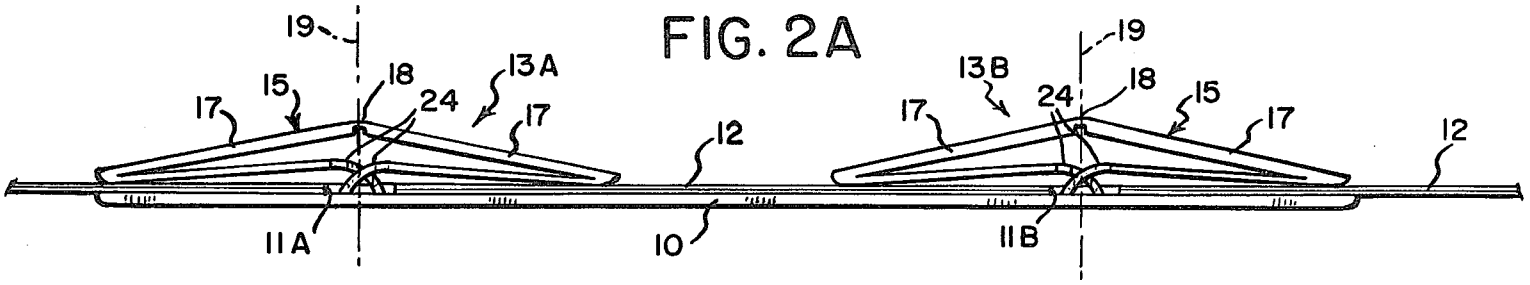
FIGS. 2A, 2B, and 2C are side, top, and expanded views of an alternative embodiment of the invention which is substantially self-locking.
Figure 2B:
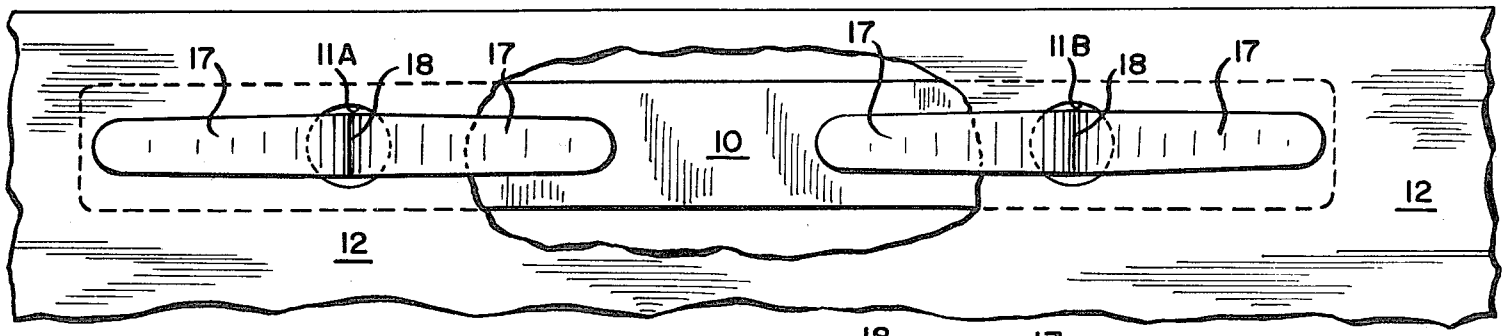
Figure 2C:
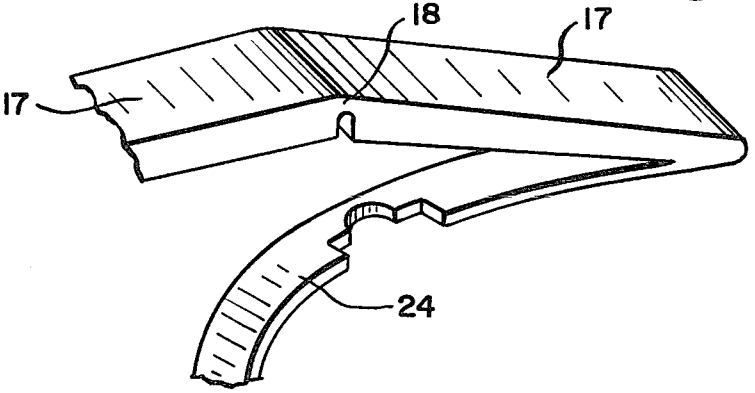

Second Embodiment (FIGS. 2A, 2B, and 2C)

FIGS. 2A, 2B, and 2C are side, top, and enlarged portion views of an alternative embodiment of a sheet binding device which is substantially self-locking. This embodiment is substantially the same as that shown in FIGS. 1A and 1B, except that the connecting portion comprises a pair of criss-crossing pillar-like members 24, each extending from the backing member on one side of the longitudinal axis of the fastener, crossing the longitudinal axis, and connecting to an arm on the other side of the axis. These criss-crossing members provide a spring force for biasing the arms into an over-center locking position after their insertion through the pre-punched holes in the collapsed position.

Figure 3:
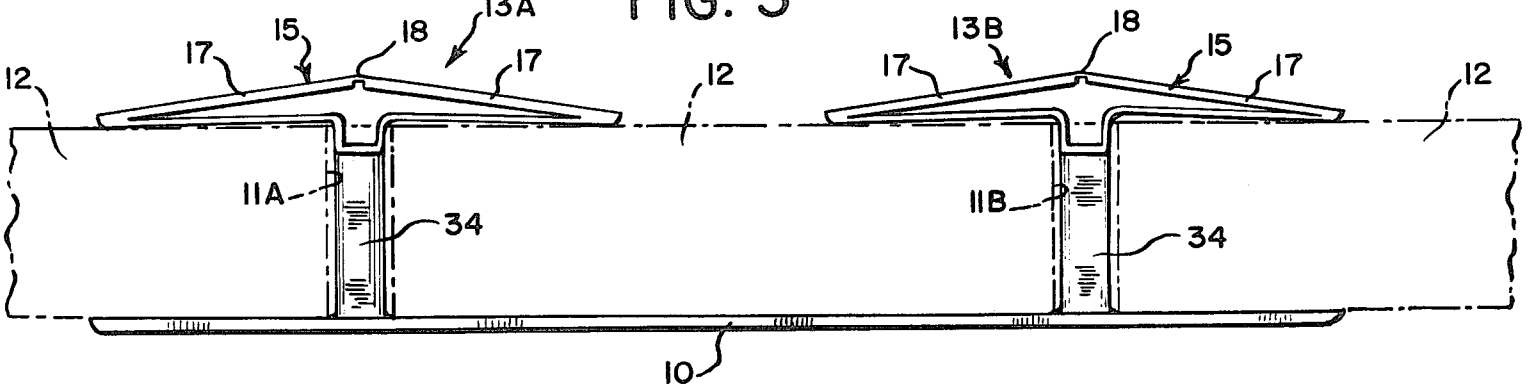
FIG. 3 is a side view of an alternative embodiment of the invention which is suitable for binding thick layers of sheet material.

Third Embodiment (FIG. 3)

FIG. 3 is a side view of an alternative embodiment of a sheet binding device which is particularly suitable for binding thick layers of sheet material. This embodiment is substantially the same as that shown in FIG. 1, except that here the connecting portion comprises an elongated strap-like member 34, which is preferably molded as an integral part of the binding device.

Figure 4A:
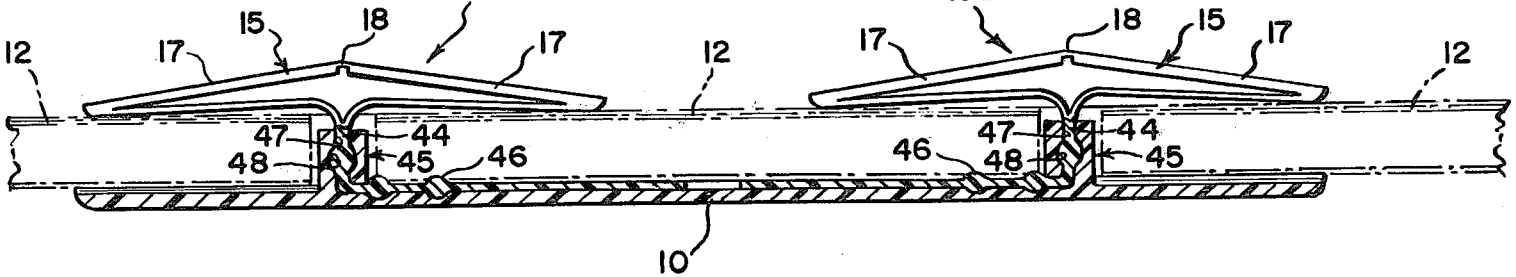
FIGS. 4A and 4B are side and top views, respectively, of an alternative embodiment of the invention which is adjustable for bonding different thicknesses of sheet material.
Figure 4B:
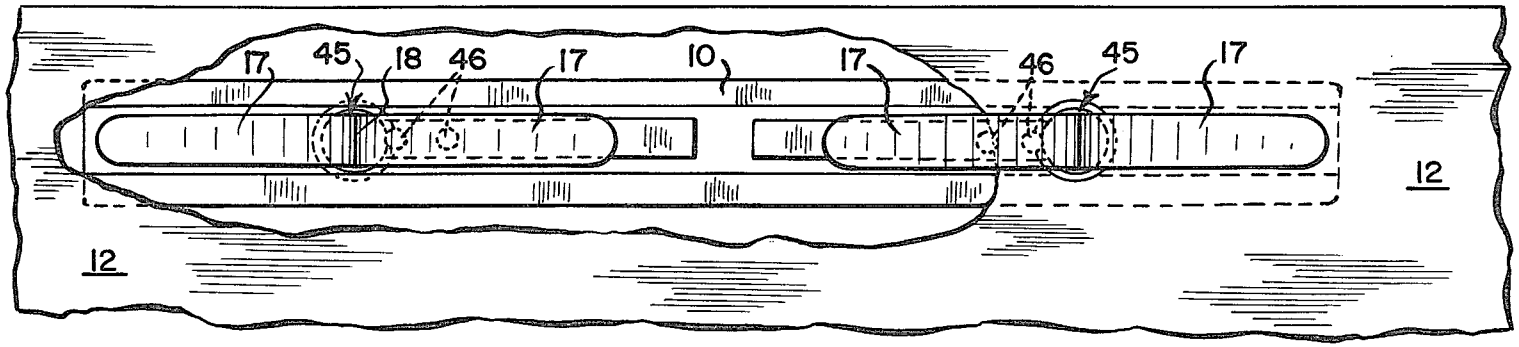

Fourth Embodiment (FIGS. 4A and 4B)

FIGS. 4A and 4B illustrate an alternative embodiment of a sheet binding device in accordance with the invention which is adjustable for binding different thicknesses of layers of sheet materials. While this device is similar to that described in connection with FIG. 3 above, it utilizes as connectors, an adjustable resilient strap member 44 which can be adjustably secured at various discrete lengths to a connector base element 45 attached to the backing member. Advantageously, the connector base is of a suitable transverse cross section to fit within the pre-punched paper openings. Such adjustable securement can be obtained, for example, by providing strap 44 with a plurality of longitudinally spaced-apart regions of transverse enlargement 46 and providing each connector base element 45 with a strap slot 47 having one or more receiving areas 48 of corresponding enlargement for securing the strap against longitudinal pullout.

To adjust the strap for different thicknesses, one need merely pull the strap sideways from the connector base and reinsert it at the appropriate position. The fastener is then inserted into the pre-punched holes for the sheet material and these holes surround the connector base, preventing accidental sideways removal of the strap.

This embodiment is made by separate injection moldings of the backing members (including connector bases) and the resilient strap members (including the locking means).

Figure 5:
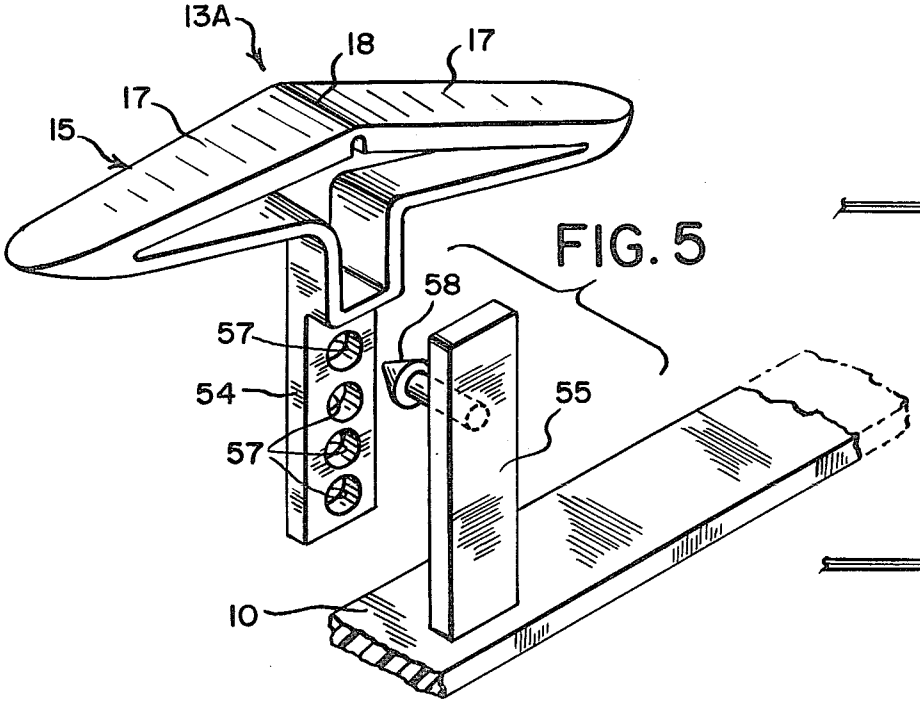
FIG. 5 is a perspective view of a second example of an adjustable thickness binding device in accordance with the invention.

Fifth Embodiment (FIG. 5)

FIG. 5 is a perspective portion view of an alternative form of an adjustable sheet binding device in accordance with the invention. Here instead of being attached to a flexible strap, the locking means is connected by a pillar-like member 54 to a pillar-like connector base 55. For connection, one of these pillar-like members, in this case 54, can be provided with a plurality of spaced apertures 57, and the other, here 55, can be provided with a retaining stud 58.

The total length of the connector comprising pillars 54 and 55 can be readily adjusted by transversely removing the stud from one aperture and putting it into another. Accidental removal can be prevented by choosing the stud length such that the circumference of the pre-punched paper holes prevents complete transverse separation of the stud and aperture, when paper is loaded into the fastening device.

While each of the multiple-hole binder devices of FIGS. 1–5 have been described in relation to two-fastener embodiments appropriate for binding sheets with a pair of spaced pre-punched holes, it is clear that three, four, or more fasteners can be provided on a single backing member to bind sheets having a corresponding number of spaced holes.

Single-Hole Embodiments (FIGS. 6, 7, 8, 9, and 10)

FIGS. 6, 7, 8, 9, and 10 illustrate alternative embodiments of single-hole sheet binders in accordance with the invention.

Figure 6:
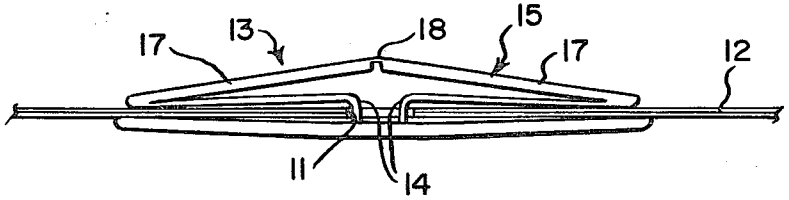
FIGS. 6, 7, 8, 9, and 10 are perspective views of single-hole embodiments of the invention.

The embodiment of FIG. 6 is substantially the same as that shown in FIGS. 1A and 1B, except that here the backing member is shortened to include but a single fastener and displaced, as by bending or curving, towards the locking arms in order to resiliently bias the paper between the backing and the locking arms. Alternatively, the arms could be displaced towards the backing member to effect the desired resilient biasing.

Figure 7:
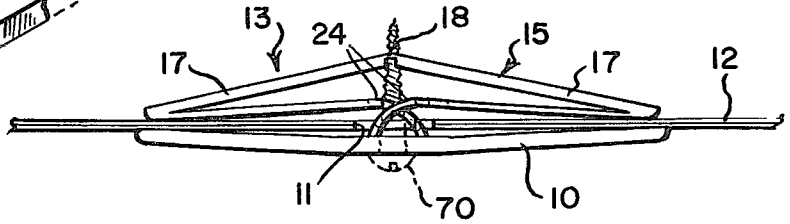

The embodiment of FIG. 7 also includes a shortened, single-fastener backing member. In this embodiment, however, the fastener is of the criss-cross type described in connection with FIGS. 2A, 2B, and 2C. This fastener can be locked in the expanded position by the insertion of an elongated retaining means 70 such as a self-threading screw or other retaining stud along the longitudinal axis, as shown.

Figure 8:
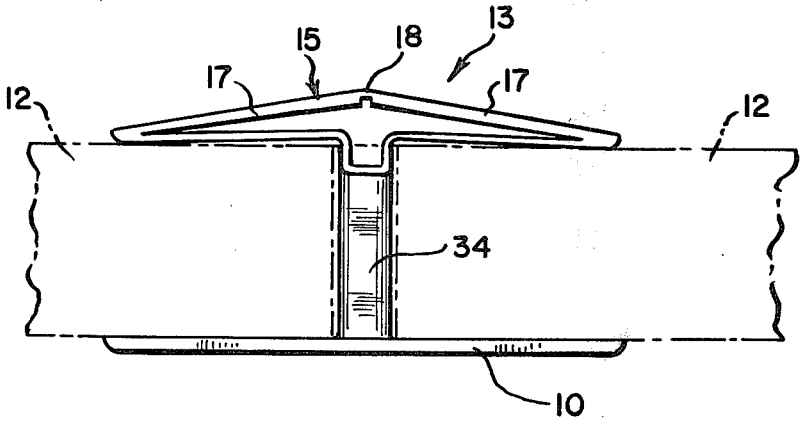

In the embodiment of FIG. 8, the fastener is of the extended strap type described in connection with FIG. 3.

Figure 9:
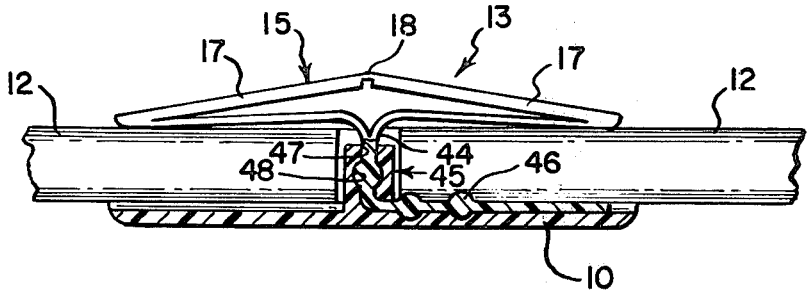

In the embodiment of FIG. 9, the fastener is of the adjustable strap type described in connection with FIGS. 4A and 4B.

Figure 10:
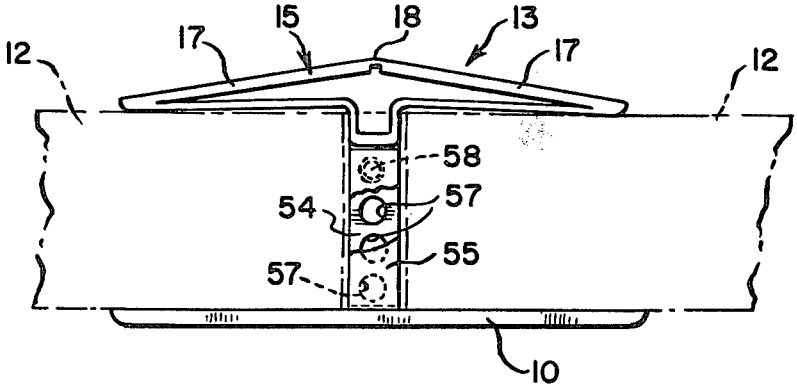

And in the embodiment of FIG. 10, the fastener is of the adjustable pillar type described in connection with FIG. 5.

While the invention has been described in connection with a small number of specific embodiments, it will be understood that these are merely illustrative of the many other specific embodiments which also utilize the principles of the invention. For example, while the device has been described as binding sheets of paper, it can also be utilized for binding sheets of other material such as plastic, wallboard, plywood, fiberboard, and the like, and for fastening objects to such sheets. Thus, numerous and varied devices can be made by those skilled in the art without departing from the spirit and scope of the present invention.

We claim:

1. A sheet binding device for fastening to one or more sheets having spaced-apart openings comprising:

an elongated backing member extending between such spaced-apart openings; and attached to said backing member at spaced-apart positions corresponding to the spacing between such openings, a plurality of fastening elements, each comprising a connecting portion for insertion into such openings, and at the end of said connecting portion remote from said backing member, locking means movable between a collapsed position in which the fastening element is insertable into such opening and an expanded over-center locking position in which said locking means is effective to preclude removal of said fastening element.

2. A sheet binding device according to claim 1 wherein at least one fastening element of said plurality of fastening elements comprises a pair of pillar-like connecting members; and locking means comprising a pair of substantially rigid arms connected to said pillar-like members and connected to each other on a longitudinal axis of the fastener by a relatively thin strap so as to be movable towards and away from each other in a plane including the longitudinal axis.

3. A sheet binding device according to claim 2 wherein said rigid arms of said locking means and said elongated backing member are shaped as to resiliently bias said sheets between them.

4. A sheet binding device according to claim 1 comprising an integrally molded structure of plastic material.

5. A sheet binding device according to claim 2 wherein the connecting portion of at least one said fastening element comprises a pair of criss-crossing pillar-like members, each extending from said backing member on one side of the longitudinal axis of said fastener, crossing said longitudinal axis, and connecting to one of said arms on the other side of said axis.

6. A sheet binding device according to claim 1 wherein the connecting portion of at least one said fastening element comprises an elongated strap-like member.

7. A sheet binding device according to claim 1 wherein the connecting portion of at least one said fastening element comprises an adjustable length resilient strap member which can be adjustably secured at various lengths to said backing member.

8. A sheet binding device according to claim 1 further comprising means for adjusting the length of the connecting portion of at least one said fastening element.

9. A sheet binding device according to claim 8 wherein said connecting portion comprises an adjustable length strap and a connector base element secured to said backing member; and said means for adjusting the length of said connecting portions comprises a plurality of regions of transverse enlargement longitudinally spaced along said strap and disposed in said connector base element a strap slot for receiving said strap having one or more receiving areas of corresponding enlargement for receiving the enlarged portions of said strap and securing said strap against longitudinal pullout.

10. A sheet binding device according to claim 8 wherein said connecting portion comprises a pillar-like member and a connector base element secured to said backing member; and said means for adjusting the length of said connecting portions comprises a retaining stud extending from either said pillar-like portion or said base and a receiving aperture disposed on the other.

11. A fastening element for fastening together a plurality of sheets, each having at least one opening therein; comprising:

a backing member;

attached to said backing member a connecting portion for insertion into such opening of said sheets;

locking means comprising a pair of substantially rigid arms connected to said connecting portion and connected to each other on a longitudinal axis of the fastener by a relatively thin strap so as to be movable towards each other to a collapsed position and away from each other to an overcenter locking position in a plane including the longitudinal axis; and wherein said backing member and said locking means are shaped as to resiliently bias said sheets between them.

12. A fastening element for securement within an opening in sheet material comprising:

a backing member;

attached to said backing member a pair of crisscrossing pillar-like members, each extending from said backing member on one side of the longitudinal axis of said fastener across the longitudinal axis to the other side of said axis; and attached to said pillar-like members, locking means movable between a collapsed position in which the fastening element is insertable into such opening and an expanded overcenter locking position in which said locking means is effective to preclude removal of said fastening element from such sheet material.

13. A fastening element according to claim 12 further including an elongated retaining means inserted along the longitudinal axis of the fastener for locking the fastener in the expanded position.

14. A fastening element according to claim 12 wherein said locking means comprises a pair of substantially rigid arms connected to said pillar-like members and connected to each other on said longitudinal axis by a relatively thin strap so as to be movable towards and away from each other in a plane including said longitudinal axis.

15. A fastening element for securement within an opening in sheet material comprising:

a backing member;

attached to said backing member an elongated strap-like connecting element; and attached to said strap-like element, locking means movable between a collapsed position in which the fastening element is insertable into such opening and an expanded over-center locking position in which said locking means is effective to preclude removal of said fastening element from such sheet material.

16. A fastening element according to claim 14 wherein said strap-like connecting element comprises an adjustable length resilient strap member which can be secured at various lengths to said backing member.

17. A fastening element for securement within an opening in sheet material comprising:

a backing member;

attached to said backing member a connector base element;

a pillar-like connecting portion;

retaining stud and receiving aperture means for connecting said connecting portion to said connector base element; and attached to said connecting portion, locking means movable between a collapsed position in which the fastening element is insertable into such opening and an expanded over-center locking position in which said locking means is effective to preclude removal of said fastening element from said sheet material.

* * * * *